US009104136B2

(12) United States Patent
Nakano et al.

(10) Patent No.: US 9,104,136 B2
(45) Date of Patent: Aug. 11, 2015

(54) DEVELOPER CONVEYANCE DEVICE, DEVELOPMENT DEVICE, AND IMAGE FORMING APPARATUS

(71) Applicant: KYOCERA DOCUMENT SOLUTIONS INC., Osaka (JP)

(72) Inventors: Kuniaki Nakano, Osaka (JP); Eiji Nimura, Osaka (JP); Koji Kuramashi, Osaka (JP); Hiroshi Yamazaki, Osaka (JP); Yoshihiro Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/944,684

(22) Filed: Jul. 17, 2013

(65) Prior Publication Data

US 2014/0023403 A1 Jan. 23, 2014

(30) Foreign Application Priority Data

Jul. 20, 2012 (JP) ..... 2012-161093

(51) Int. Cl.
*G03G 15/08* (2006.01)
*G03G 15/09* (2006.01)

(52) U.S. Cl.
CPC ..... *G03G 15/0865* (2013.01); *G03G 15/0893* (2013.01); *G03G 15/0822* (2013.01); (Continued)

(58) Field of Classification Search
CPC ..... G03G 15/08
USPC ..... 399/254
See application file for complete search history.

(56) References Cited

U.S. PATENT DOCUMENTS

2006/0140679 A1* 6/2006 Iwata et al. ..... 399/254

FOREIGN PATENT DOCUMENTS

JP H0535091 * 2/1993 ..... G03G 15/08
JP H04218078 * 8/1997 ..... G03G 15/08

(Continued)

OTHER PUBLICATIONS

An Office Action; "Notice of Reason for Rejection," issued by the Japanese Patent Office on Jul. 15, 2014, which corresponds to Japanese Patent Application No. 2012-161093 and is related to U.S. Appl. No. 13/944,684.

*Primary Examiner* — Clayton E Laballe
*Assistant Examiner* — Kevin Butler
(74) *Attorney, Agent, or Firm* — Studebaker & Brackett PC

(57) ABSTRACT

A developer conveyance device includes a housing and a conveyance member. The conveyance member is supported to the housing and rotates to convey developer. The conveyance member includes a shaft portion, a helical member, and a plurality of reinforcement members. The plurality of reinforcement members are disposed in a circumferential direction of rotation of the conveyance member. When viewing a cross section in a direction intersecting with the rotational axis, an outer circumferential surface of the helical member includes a facing region and a non-facing region, which are defined for one reinforcement member of the plurality of reinforcement members, the facing region being a region where the one reinforcement member of the plurality of reinforcement members is projected on an opposite side of an outer circumferential surface of the helical member through the rotational axis, and the non-facing region being a region of the outer circumferential surface of the helical member which is different from the facing region. The other reinforcement member of the plurality of reinforcement members is disposed in the non-facing region.

(56) References Cited

FOREIGN PATENT DOCUMENTS

| | | | | |
|---|---|---|---|---|
| JP | 2004-307140 | * | 11/2004 | ..... G03G 15/08 |
| JP | 2004-307140 A | | 11/2004 | |
| JP | 2005-037671 | * | 2/2005 | ..... G03G 15/08 |
| JP | 2005-352042 | * | 12/2005 | ..... G03G 15/08 |
| JP | 2006-163292 | * | 6/2006 | ..... G03G 15/08 |
| JP | 2012-032718 | * | 2/2012 | ..... G03G 15/08 |
| JP | 2012-032718 A | | 2/2012 | |

* cited by examiner

DEVELOPER CONVEYANCE DEVICE, DEVELOPMENT DEVICE, AND IMAGE FORMING APPARATUS

INCORPORATION BY REFERENCE

The present application claims priority under 35 U.S.C. §119 to Japanese Patent Application No. 2012-161093, filed Jul. 20, 2012. The contents of this application are incorporated herein by reference in their entirety.

BACKGROUND

The present disclosure relates to developer conveyance devices, development devices including such a developer conveyance device, and image forming apparatuses including such a development device.

For development devices, a stirring screw is fitted in a developing housing as a developer conveyance device for conveyance of developer. The stirring screw of a development device includes a shaft portion and a plurality of helical pieces, which are joined successively around the shaft portion. The developer is conveyed in the conveyance direction by the stirring screws being driven to rotate in the development housing.

If the adhesiveness of the developer increases due to degradation of the developer, the developer may adhere to the shaft portion of the stirring screw. If the developer adheres to the shaft portion, the shaft portion, in effect, has a larger thickness. As a result, the conveyance performance of the stirring screw decreases. A type of stirring screw does not include a shaft portion at a middle portion in the axial direction in order to obviate such increase in thickness of the stirring screw. In other words, such a stirring screw has a hollow shape. That is, the stirring screw is hollow.

SUMMARY

A developer conveyance device according to the present disclosure includes: a housing; and a conveyance member. The conveyance member is supported by the housing and configured to rotate so as to convey developer. The conveyance member includes: a shaft portion, a hollow helical member, and a plurality of reinforcement member. The shaft portion rotates about a rotational axis. The hollow helical member extends in a direction of the rotational axis and is formed in a helical shape. The plurality of reinforcement members support the helical member and extend in the direction of the rotational axis. The plurality of reinforcement members are disposed in a circumferential direction of rotation of the conveyance member. When viewing a cross section in a direction intersecting with the rotational axis, an outer circumferential surface of the helical member includes a facing region and a non-facing region, which are defined for one reinforcement member of the plurality of reinforcement members. The facing region is a region where the one reinforcement member of the plurality of reinforcement members is projected on an opposite side of an outer circumferential surface of the helical member through the rotational axis. The non-facing region is a region of the outer circumferential surface of the helical member which is different from the facing region. The other reinforcement member of the plurality of reinforcement members is disposed in the non-facing region.

A development device according to the present disclosure includes: the aforementioned developer conveyance device; and a development roller rotatably supported by the housing and configured to carry the developer conveyed by developer conveyance device.

An image forming apparatus according to the present disclosure includes: the above development device; and an image carrier having a circumferential surface on which an electrostatic latent image is to be formed and provided so as to face the development roller.

DETAILED DESCRIPTION

Figure 1:
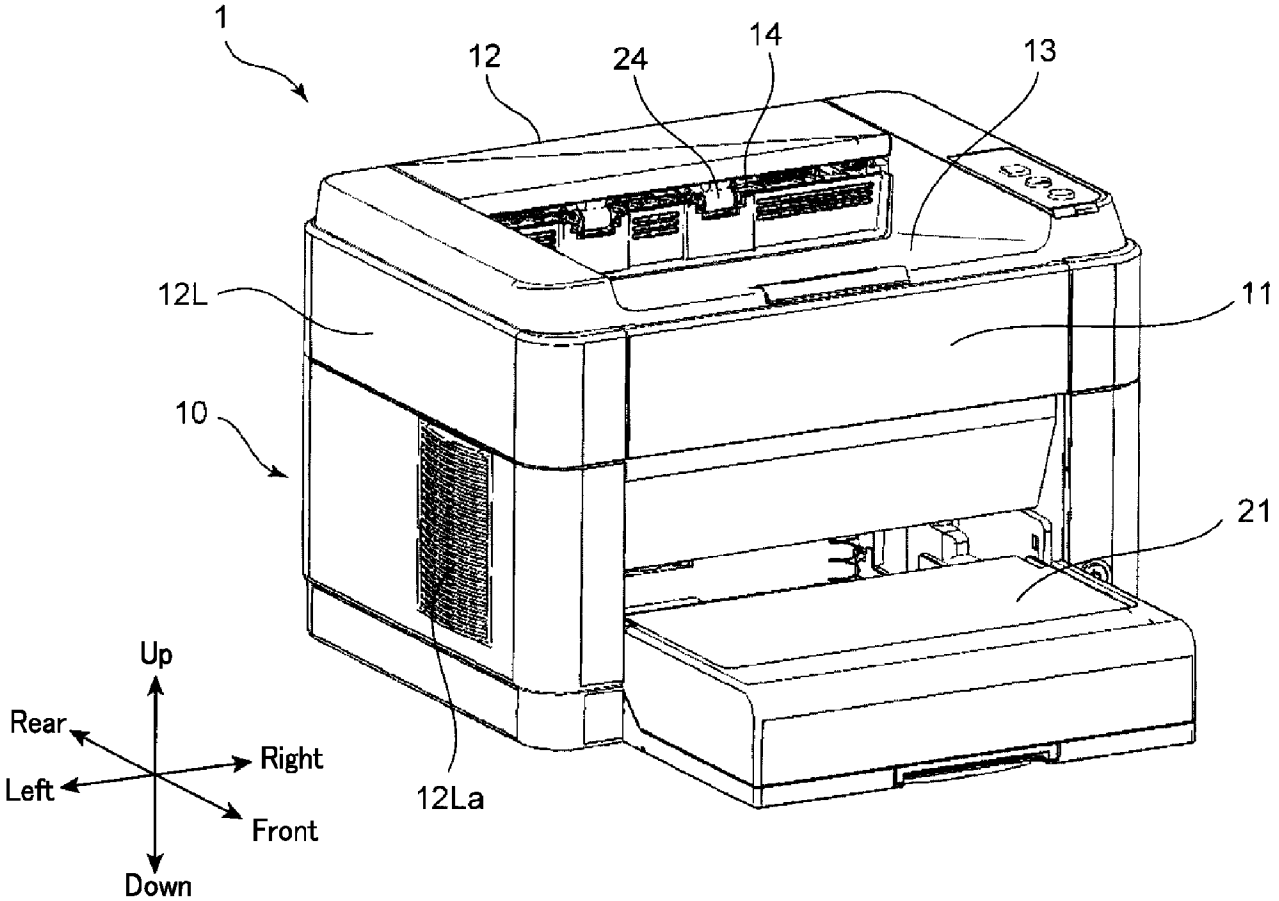
FIG. 1 is a perspective view showing an external appearance of an image forming apparatus according to one embodiment of the present disclosure.

Embodiments of the present disclosure will be described in detail hereinafter with reference to the accompanying drawings. The same or corresponding parts are designated by the same reference characters in the drawings and will not be redundantly described.

Figure 2:
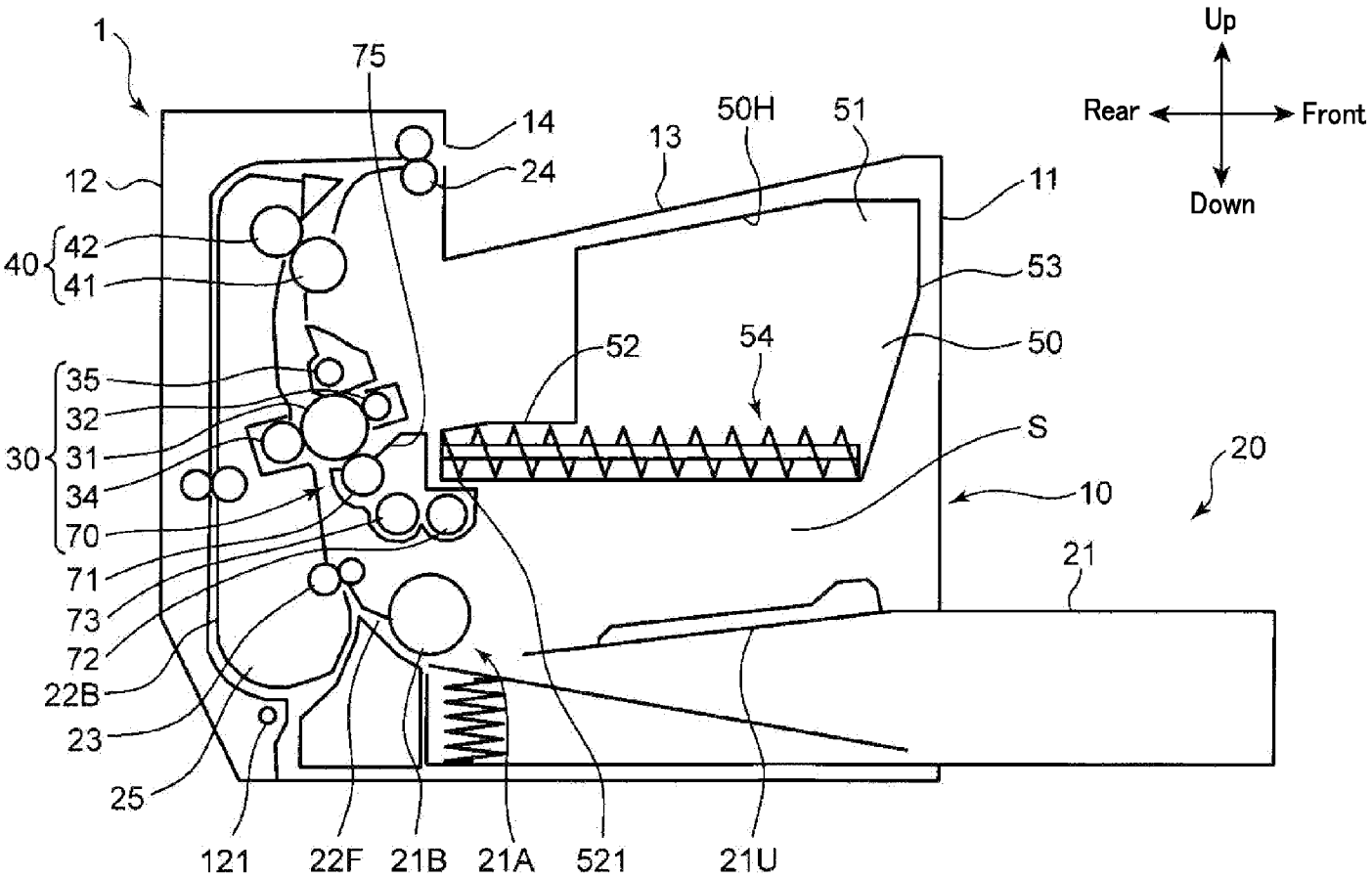
FIG. 2 is a cross-sectional side view showing an internal structure of the image forming apparatus of the embodiment of the present disclosure.

FIG. 1 is a perspective view showing an external appearance of an image forming apparatus 1 according to one embodiment of the present disclosure. FIG. 2 is a cross-sectional side view showing an internal structure of the image forming apparatus 1 of the embodiment of the present disclosure. In this embodiment, the image forming apparatus 1 is exemplified by a monochromatic printer. However, the image forming apparatus of the embodiment of the present disclosure may be a copier, a fax machine, or a multifunction peripheral having these functions, or an image forming apparatus which forms a color image.

The image forming apparatus 1 includes a body housing 10, a paper feed section 20, an image forming section 30, a fusing section 40, and a toner container 50. The body housing 10 has a generally rectangular parallelepiped shape. The paper feed section 20, the image forming section 30, the fusing section 40, and the toner container 50 are accommodated in the body housing 10.

The body housing 10 includes a front cover 11 at a front surface thereof and a rear cover 12 at a rear surface thereof. When the front cover 11 is opened, the toner container 50 is exposed at the front surface. As a result, when the image forming apparatus 1 runs out of toner, the user can remove the toner container 50 through the front surface of the body housing 10. The rear cover 12 is opened for sheet jam clearance or maintenance. When the rear cover 12 is opened, a unit including the image forming section 30 and a unit including the fusing section 40 can each be removed through the rear surface of the body housing 10. The body housing 10 includes, at side surfaces thereof, a left cover 12L (FIG. 1) and a right cover 12R (not shown in FIG. 1) each of which extends in a vertical direction. The right cover 12R is provided on the opposite side with respect to the left cover 12L. An air inlet 12La for taking air into the body housing 10 is provided at a front portion of the left cover 12L. A paper exit section 13 onto which a sheet after image formation is to be exited is provided at an upper surface of the body housing 10. Devices for forming an image are provided in an internal space S shown in FIG. 2. The internal space S is formed by the front cover 11, the rear cover 12, the left cover 12L, the right cover 12R, and the paper exit section 13.

The paper feed section 20 includes a paper feed cassette 21 which stores sheets on which an image is to be formed (FIG. 2). A portion of the paper feed cassette 21 protrudes forward from the front surface of the body housing 10. An upper surface of a portion of the paper feed cassette 21 which is accommodated in the body housing 10 is covered by a paper feed cassette top plate 21U. The paper feed cassette 21 includes a sheet storage space in which a stack of sheets is stored, a lift plate which lifts up the stack of sheets for paper feed, and the like. A sheet pickup section 21A is provided at an upper portion of a rear end portion of the paper feed cassette 21. A feed roller 21B is provided in the sheet pickup section 21A. The feed roller 21B picks up an uppermost sheet of the sheet stack in the paper feed cassette 21 on a sheet-by-sheet basis.

The image forming section 30 performs an image forming process. The image forming process is a process of forming a toner image on a sheet fed from the paper feed section 20. The image forming section 30 includes a photoconductive drum 31 (image carrier), a charging device 32, an exposure device (not shown in FIG. 2), a development device 70, a transfer roller 34, and a cleaning device 35. The charging device 32, the exposure device, the development device 70, the transfer roller 34, and the cleaning device 35 are disposed around the photoconductive drum 31. The image forming section 30 is disposed between the left and right covers 12L and 12R.

The photoconductive drum 31 includes a rotating shaft (not shown), and a cylinder which rotates about the rotating shaft. On a circumferential surface (hereinafter referred to as a "cylinder surface") of the cylinder, an electrostatic latent image is formed, and a toner image corresponding to an electrostatic latent image is carried. The photoconductive drum 31 may be one which is formed, for example, of an amorphous silicon (a-Si)-based material.

The charging device 32 includes a charging roller which comes into contact with the photoconductive drum 31. The charging device 32 uniformly charges the surface of the photoconductive drum 31.

The cleaning device 35 has a cleaning blade (not shown) to clean toner adhering to the cylinder surface of the photoconductive drum 31 after transfer of a toner image. The cleaning device 35 also conveys the cleaned toner to a collection device (not shown). The photoconductive drum 31, the charging device 32, and the cleaning device 35 are integrated together to form a drum unit.

The exposure device has a laser light source and optical elements, such as a mirror, a lens, and the like. The exposure device irradiates the cylinder surface of the photoconductive drum 31 with light to form an electrostatic latent image. The irradiation light is modulated by the exposure device based on image data input from an external apparatus, such as a personal computer or the like. The development device 70 supplies toner to the cylinder surface of the photoconductive drum 31 in order to develop the electrostatic latent image formed on the cylinder surface of the photoconductive drum 31 for formation of a toner image. The development device 70 includes a development roller 71, and a first conveyance screw 72 and a second conveyance screw 73. The development roller 71 carries toner which is to be supplied to the photoconductive drum 31. The first and second conveyance screws 72 and 73 convey and circulate a developer in the development housing while stirring the toner. It is noted that the development device 70 will be described below with reference to FIGS. 3, 4, 5A, 5B, 6A, 6B, and 7.

The transfer roller 34 is used to transfer a toner image formed on the cylinder surface of the photoconductive drum 31 to a sheet. The transfer roller 34 comes into contact with the cylinder surface of the photoconductive drum 31 to form a transfer nip. A transfer bias having a polarity opposite to that of the toner is applied to the transfer roller 34.

The fusing section 40 performs a fusing process. The fusing process is a process of fusing the transferred toner image to a sheet. The fusing section 40 includes a fusing roller 41 and a pressure roller 42. The fusing roller 41 includes a heat source in an interior thereof. The pressure roller 42 is pressed against and in contact with the fusing roller 41. As a result, a fusing nip is formed between the pressure roller 42 and the fusing roller 41. When the sheet to which the toner image has been transferred passes through the fusing nip, the toner image is fused to the sheet by heat of the fusing roller 41 and pressure of the pressure roller 42.

The toner container 50 stores toner which is to be replenished to the development device 70. The toner container 50 includes a container body 51, a cylindrical portion 52, a lid member 53, and a rotating member 54. The container body 51 is a main portion in which the toner is stored. The cylindrical portion 52 protrudes from a lower portion of a rear surface of the container body 51. The lid member 53 covers a front surface of the container body 51. The rotating member 54 is accommodated in an interior of the container and conveys the toner. The toner stored in the toner container 50 is supplied from a toner outlet 521 to the development device 70 by the rotating member 54 being driven and rotated. The toner outlet 521 is provided in a lower surface at a tip of the cylindrical portion 52. A container top plate 50H which covers an upper portion of the toner container 50 is disposed below the paper exit section 13.

In the body housing 10, a main conveyance path 22F, and a reverse conveyance path 22B are formed in order to convey a sheet. The main conveyance path 22F extends from the sheet pickup section 21A of the paper feed section 20 through the image forming section 30 and the fusing section 40 to a paper exit opening 14. The paper exit opening 14 is disposed to face the paper exit section 13 at the upper surface of the body housing 10. The reverse conveyance path 22B, when duplex printing is performed on a sheet, serves as a conveyance path for conveying the sheet on one side of which printing has been performed. The reverse conveyance path 22B returns the sheet on one side of which printing has been performed, to an upstream side of the image forming section 30 in the main conveyance path 22F.

The main conveyance path 22F is formed to pass through the transfer nip in a direction from a bottom portion to an upper portion of the image forming apparatus 1. The transfer nip is formed by the photoconductive drum 31 and the transfer roller 34. A registration roller pair 23 is provided upstream of the transfer nip in the main conveyance path 22F. A sheet is temporarily stopped by the registration roller pair 23 for skew correction, and thereafter, is fed to the transfer nip with predetermined timing for image transfer. A plurality of conveyance rollers for conveying a sheet are provided at appropriate points in the main conveyance path 22F and the reverse conveyance path 22B. For example, a paper exit roller pair 24 is provided in the vicinity of the paper exit opening 14.

The reverse conveyance path 22B is formed between an outer surface of a reversal section 25 and an inner surface of the rear cover 12 of the body housing 10. It is noted that the transfer roller 34 and one roller of the registration roller pair 23 are disposed at the inner surface of the reversal section 25. The rear cover 12 and the reversal section 25 can each rotate about the axis of a pivot portion 121 provided at a lower end thereof. When a sheet jam occurs in the reverse conveyance path 22B, the rear cover 12 is opened. When a sheet jam occurs in the main conveyance path 22F, or when a unit including the photoconductive drum 31 or the development device 70 is removed from the development device 70, the reversal section 25 is also opened in addition to the rear cover 12.

<Detailed Configuration of Development Device>

Figure 3:
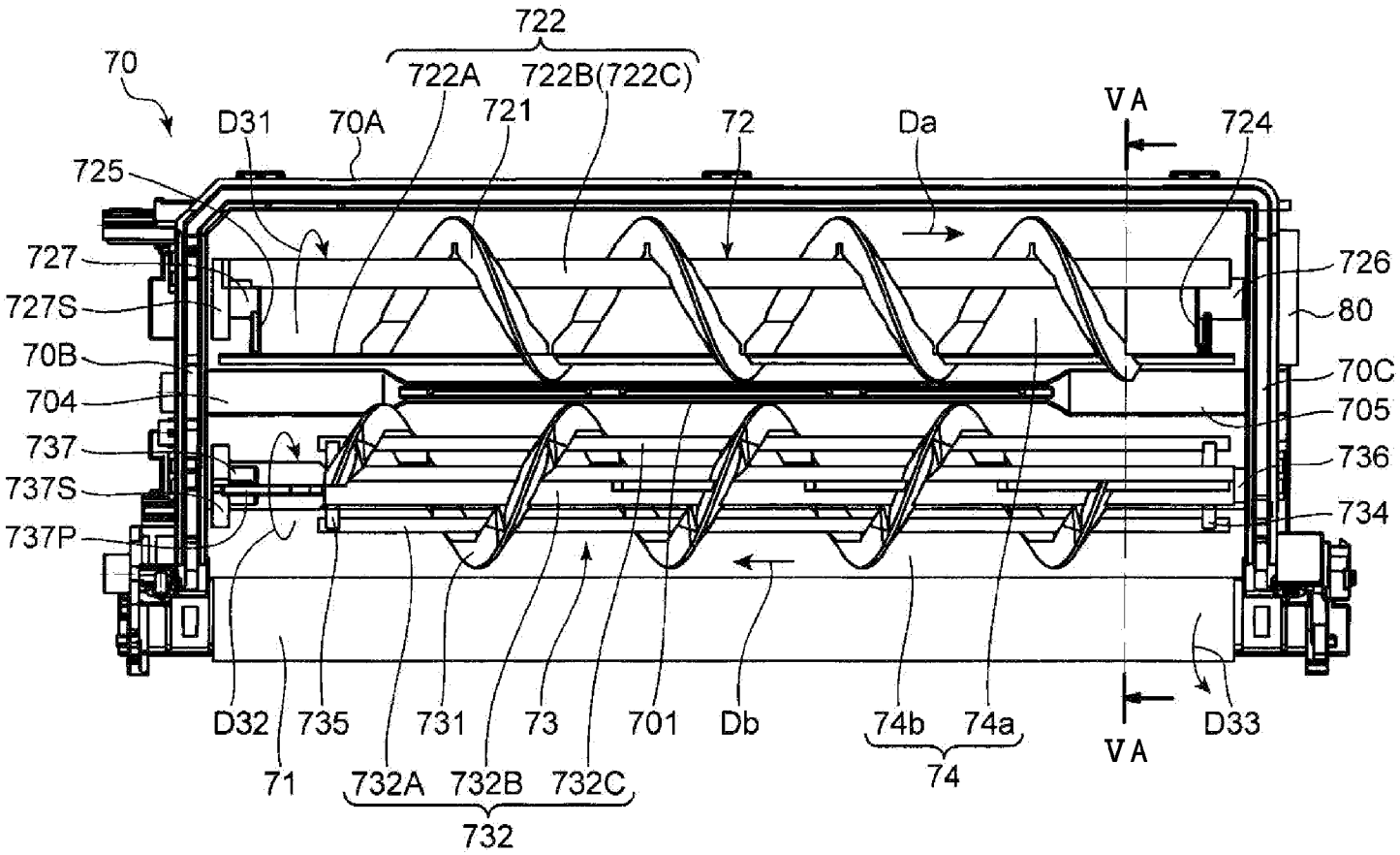
FIG. 3 is a plan view showing an internal structure of a development device according to the embodiment of the present disclosure.
Figure 4:
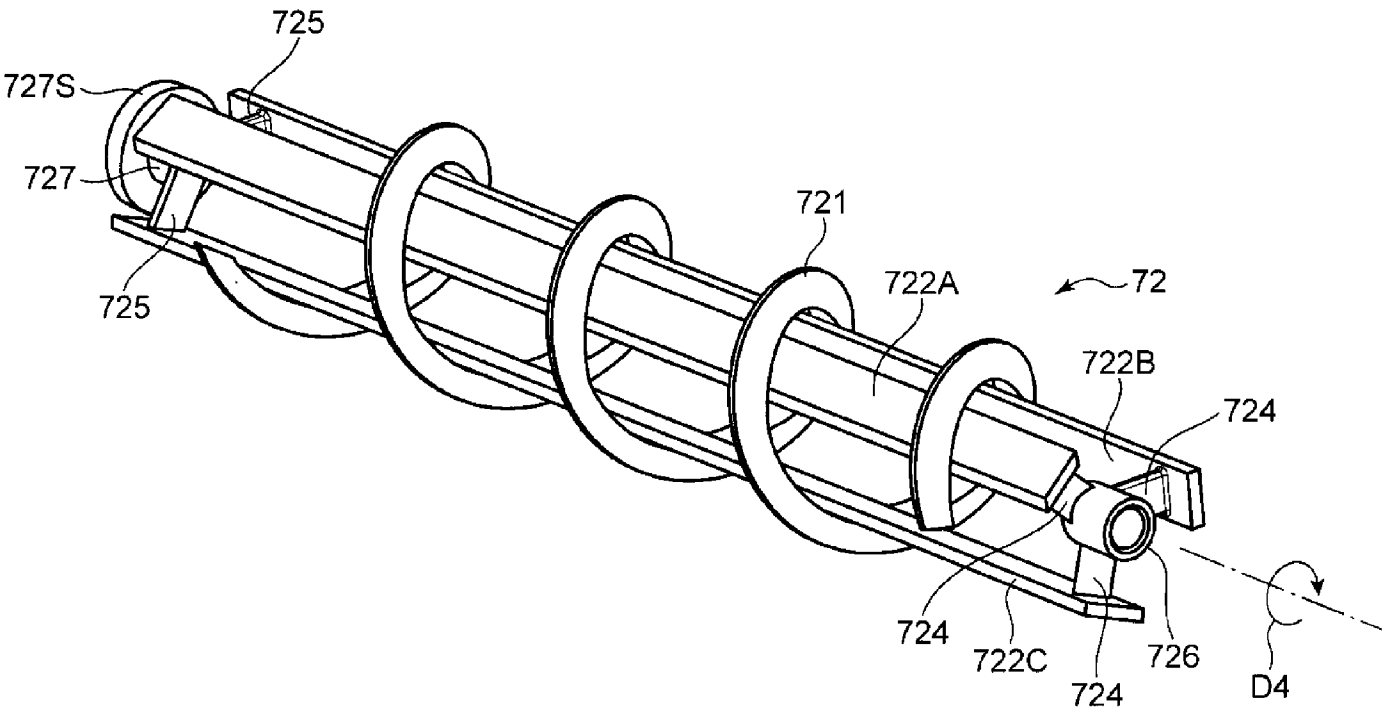
FIG. 4 is a perspective view showing a conveyance screw according to the embodiment of the present disclosure.
Figure 5A:
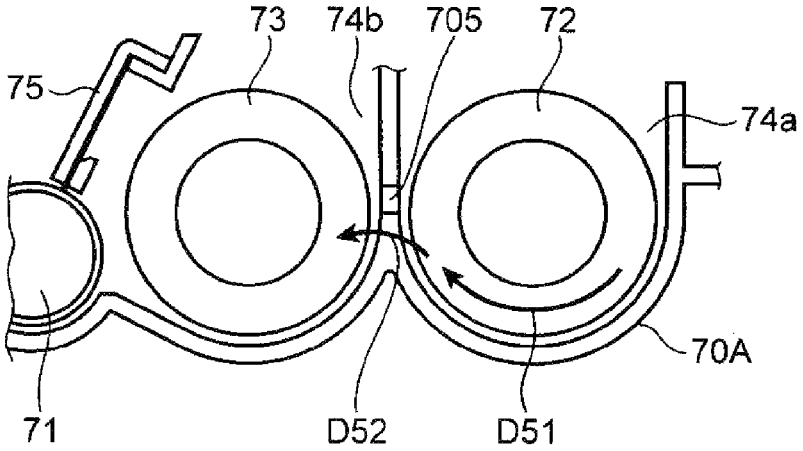
FIGS. 5A and 5B are cross sectional views each showing a development device according to the embodiment of the present disclosure.
Figure 5B:
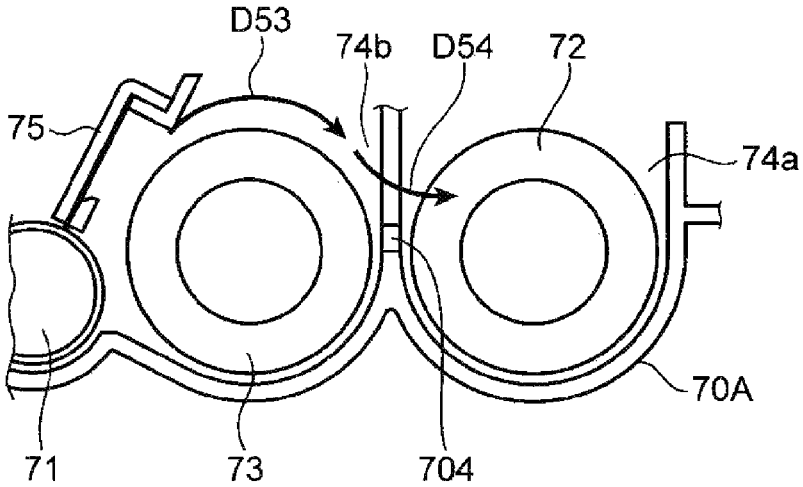

With reference to FIGS. 3-5, the configuration of the development device 70 according to the present embodiment will be described next in detail. FIG. 3 is a plan view of a developer housing 70A of the development device 70. FIG. 4 is a perspective view of the first conveyance screw 72. FIGS. 5A and 5B are each a cross sectional view of the developer housing 70A of the development device 70 taken along the line VA-VA (FIG. 3).

The development device 70 includes the developer housing 70A (housing), which defines an interior space of the development device 70. The developer housing 70A includes a lid portion (a lid, not shown) and a bottom portion. The lid portion covers rollers accommodated in an interior thereof from above. The bottom portion is connected to the lid portion. The bottom portion forms a lower surface portion of the developer housing 70A. It is noted that FIG. 3 shows the bottom portion of the developer housing 70A. The developer housing 70A includes a pair of wall portions (walls) of a first wall portion 70C and a second wall portion 70B.

The development housing 70A has a developer reservoir section 74. The developer reservoir section 74 is a cavity which stores a developer composed of toner which is a magnetic material. The developer reservoir section 74 conveys the developer while stiffing the developer. In an interior of the development housing 70A, the development roller 71, a developer regulating blade 75 (FIG. 2), and the first conveyance screw 72 and the second conveyance screw 73 are provided. The developer regulating blade 75 is disposed to face the development roller 71. The first and second conveyance screws 72 and 73 stir and convey the developer.

The developer reservoir section 74 includes a first conveyance portion 74*a* (developer conveyance path) and a second conveyance portion 74*b* (developer conveyance path). The first and second conveyance portions 74*a* and 74*b* are formed between the first and second wall portions 70C and 70B, extending in a longitudinal direction of the development device 70. The first and second conveyance portions 74*a* and 74*b* are adjacent and parallel to each other. The first and second conveyance portions 74*a* and 74*b* are separated from each other by a separation plate 701. The separation plate 701 is integrally formed with the bottom portion of the development housing 70A, extending in the longitudinal direction of the development device 70.

One end portion of the first conveyance portion 74*a* and one end portion of the second conveyance portion 74*b* are in communication with each other via a first communication portion 705 (first communication path) (see FIG. 3). These end portions of the first and second conveyance portions 74*a* and 74*b* are end portions in the longitudinal direction of the development device 70. The other end portion of the first conveyance portion 74*a* and the other end portion of the second conveyance portion 74*b* are in communication with each other via a second communication portion 704 (second communication path) (see FIG. 3). These end portions of the first and second conveyance portions 74*a* and 74*b* are end portions in the longitudinal direction of the development device 70.

The first conveyance screw 72 (conveyance member) is accommodated in the first conveyance portion 74*a*, and is rotated about an axis thereof to stir and convey the developer. The second conveyance screw 73 is accommodated in the second conveyance portion 74*b*, and is rotated about an axis thereof to stir and convey the developer. In other words, the first and second conveyance screws 72 and 73 are rotatably supported by the first and second wall portions 70C and 70B. The first and second conveyance screws 72 and 73 convey the developer from one of the first and second wall portions 70A and 70B toward the other. In FIG. 3, the first conveyance screw 72 is driven and rotated in a direction indicated by an arrow D31. On the other hand, the second conveyance screw 73 is driven and rotated in a direction indicated by an arrow D32. The first and second conveyance screws 72 and 73 are set so that their developer conveyance directions are reverse to each other in their axial directions. As a result, as indicated by arrows Da and Db in FIG. 3, the developer is conveyed and stirred between the first and second conveyance portions 74*a* and 74*b* to circulate. Then, as shown in FIG. 5A, as the first conveyance screw 72 is rotated (in a direction indicted by an arrow D51), the developer is transferred from the first conveyance portion 74*a* to the second conveyance portion 74*b* through the first communication portion 705 (in a direction indicated by an arrow D52). Further, as shown in FIG. 5B, as the second conveyance screw 73 is rotated (in a direction indicated by an arrow D53), the developer is transferred from the second conveyance portion 74*b* to the first conveyance portion 74*a* through the second communication portion 704 (in a direction indicated by an arrow D54).

The development roller 71 is disposed in the longitudinal direction of the development device 70. The development roller 71 is disposed along the second conveyance screw 73. The development roller 71 is driven and rotated in a direction indicated by an arrow D33 in FIG. 3. A fixed magnet role is provided in an interior of the development roller 71. The magnet role has a plurality of magnetic poles. The developer is supplied from the second conveyance screw 73 to a circumferential surface of the development roller 71. Thereafter, the developer carried on the circumferential surface of the development roller 71 is conveyed to a downstream side in the rotational direction of the development roller 71 as the development roller 71 is rotated.

The developer regulating blade 75 (FIGS. 2, 5A, and 5B) is disposed on the circumferential surface of the development roller 71 on the downstream side of a region where the development roller 71 and the second conveyance screw 73 face each other in the rotational direction of the development roller 71. The developer regulating blade 75 is provided in a lid portion (not shown) of the development housing 70A, extending in the axial direction of the development roller 71. The developer regulating blade 75 is a plate-like member whose tip portion is disposed at a predetermined distance from the circumferential surface of the development roller 71. The thickness of a layer of the developer carried on the development roller 71 is regulated by the developer regulating blade 75. The developer on the development roller 71 is conveyed to a portion where the development roller 71 and the photoconductive drum 31 face each other. Thereafter, the developer is supplied to the cylinder surface of the photoconductive drum 31 based on an electrostatic latent image formed on the photoconductive drum 31.

With reference to FIG. 4 in addition to FIG. 3, description will be made next about the first conveyance screw 72 provided in the development device 70 according to the present embodiment.

As described above, the first conveyance screw 72 is provided in the first conveyance portion 74*a*. The first conveyance screw 72 includes a first first-shaft portion 726, a second first-shaft portion 727, a first rib group 722 (FIG. 3), a first first-connection piece 724, a second first-connection piece 725, a first screw 721, and a first seal 727S.

The first and second first-shaft portions 726 and 727 (shaft portions) are rotatably supported by the first and second wall portions 70C and 70B, respectively. The first and second first-shaft portions 726 and 727 serve as a rotational axis of the first conveyance screw 72. The first first-shaft portion 726 rotatably supports the first conveyance screw 72 at one end portion in the axial direction of the first conveyance screw 72. The second first-shaft portion 727 rotatably supports the first conveyance screw 72 at the other end portion in the axial direction of the first conveyance screw 72. The first first-shaft portion 726 includes a cylindrical bearing portion in an interior thereof. A protruding portion (not shown) which protrudes from the first wall portion 70C of the development housing 70A toward the first conveyance portion 74*a* is inserted into the bearing portion of the first first-shaft portion 726. Similarly, the second first-shaft portion 727 includes a cylindrical bearing portion in an interior thereof. A protruding portion (not shown) which protrudes from the second wall portion 70B of the development housing 70A toward the first conveyance portion 74*a* is inserted into the bearing portion of the second first-shaft portion 727. As a result, the first conveyance screw 72 is rotatably supported by the development housing 70A. In this case, an imaginary rotational axis of the first conveyance screw 72 is formed between the first and second first-shaft portions 726 and 727 in the axial direction of the first conveyance screw 72.

The first rib group 722 is composed of a plurality of rib members of a first first-rib 722A, a second first-rib 722B, and a third first-rib 722C (rib members). The first, second, and third first-ribs 722A, 722B, and 722C are provided in the circumferential direction of rotation of the first conveyance screw 72. Each of the first, second, and third first-ribs 722A, 722B, and 722C is a plate-like member provided across one end portion to the other end portion of the first conveyance screw 72. Each of the first, second, and third first-ribs 722A, 722B, and 722C is a plate-like member with a predetermined width in the circumferential direction of the first conveyance screw 72. In the present embodiment, the first, second, and third first-ribs 722A, 722B, and 722C are disposed at 120-degree intervals in the circumferential direction of the first conveyance screw 72. The first, second, and third first-ribs 722A, 722B, and 722C are provided over from the vicinity of the first first-shaft portion 726 to the vicinity of the second first-shaft portion 727 in the axial direction of the first conveyance screw 72. The first, second, and third first-ribs 722A, 722B, and 722C support the first screw 721 described below and stir the developer in the first conveyance portion 74*a*. Further, the first, second, and third first-ribs 722A, 722B, 722C reinforce the first screw 721.

The first first-connection piece 724 (support member) is disposed to face the first wall portion 70C. The first first-connection piece 724 connects an end portion on one end side of the first first-rib 722A, an end portion on one end side of the second first-rib 722B, and an end portion on one end side of the third first-rib 722C together in the radial direction of the first conveyance screw 72. The first first-shaft portion 726 protrudes from the central part of the first first-connection piece 724 outward in the axial direction of the first conveyance screw 72. In other words, the first first-connection piece 724 connects an end portion in the conveyance direction of the first first-rib 722A, an end portion in the conveyance direction of the second first-rib 722B, and an end portion in the conveyance direction of the third first-rib 722C to the first first-shaft portion 726. Similarly, the second first-connection piece 725 (support member) connects an end portion on the other end side of the first first-rib 722A, an end portion on the other end side of the second first-rib 772B, and an end portion on the other end side of the third first-rib 772C together in the radial direction of the first conveyance screw 72. The second first-shaft portion 727 protrudes from the central part of the second first-connection piece 725 outward in the radial direction of the first conveyance screw 72.

The first screw 721 (helical member) is in the shape of a helix extending in the developer conveyance direction, and forms an outer circumferential periphery of rotation of the first conveyance screw 72. Specifically, the first screw 721 is a member including helical pieces each of which forms one turn of the helix and which are joined successively so that the member extends in the conveyance direction. The first screw 721 has a hollow interior formed by the helical pieces joined successively. In other words, the first screw 721 is a hollow conveyance member in which a plurality of helical pieces are joined successively in the conveyance direction so as to form the shape of a helix. Specifically, the first screw 721 is a helical conveyance member provided at a distance in the radial direction from the imaginary rotational axis of the first conveyance screw 72 between the first and second first-shaft portions 726 and 727 to have a hollow shape in an interior thereof. The first, second, and third first-ribs 722A, 722B, and 722C connect contiguous (adjacent) helical pieces of the first screw 721 together. The configurations of the first screw 721, the first first-rib 722A, the second first-rib 722B, and the third first-rib 722C will be described in a still different way. The first screw 721 includes a plurality of helical pieces which are integrated together by the first, second, and third first-ribs 722A, 722B, and 722C. As a result, the helical first screw 721 has a hollow portion around the imaginary rotational axis. Accordingly, the first rib group 722 is composed of the three rib members, so that the these rib members stably bridge the helical pieces of the first screw 721.

The first seal 727S is a ring-shaped elastic member which is provided on an exterior in the radial direction of the second first-shaft portion 727. When the first screw 721 is mounted in the development housing 70A, the first seal 727S comes into contact with the inner wall surface of the second wall portion 70B of the development housing 70A. As a result, the first seal 727S can prevent or reduce aggregation of the developer which would occur between the second first-shaft portion 727 and the inner wall surface of the second wall portion 70B as the first conveyance screw 72 is rotated.

<Second Conveyance Screw 73>

Next, the second conveyance screw 73 will be described with reference to FIG. 3. It is noted that the second conveyance screw 73 has a shape similar to that of the first conveyance screw 72. Therefore, parts similar to those of the first conveyance screw 72 will not be described, and differences from the first conveyance screw 72 will be mainly described in detail. As described above, the second conveyance screw 73 is provided in the second conveyance portion 74*b*. The second conveyance screw 73 includes a first second-shaft portion 736, a second second-shaft portion 737, a second rib group 732 (rib member, reinforcement member), a first second-connection piece 734, a second second-connection piece 735, a paddle 737P, a second screw 731, and a second seal 737S.

The first and second second-shaft portions 736 and 737 correspond to the first and second first-shaft portions 726 and 727 of the first conveyance screw 72, respectively. The first and second second-shaft portions 736 and 737 allow the second conveyance screw 73 to be rotatably supported by the development housing 70A. In this case, the imaginary rotational axis of the second conveyance screw 73 is formed between the first and second second-shaft portions 736 and 737, extending in the axial direction of the second conveyance screw 73.

The second rib group 732 is composed of a plurality of rib members of a first second-rib 732A, a second second-rib 732B, and a third second-rib 732C (rib members). The first, second, and third second-ribs 732A, 732B, and 732C correspond to the first, second, and third first-ribs 722A, 722B, and 722C of the first conveyance screw 72, respectively. The first and second second-connection pieces 734 and 735 correspond to the first and second first-connection pieces 724 and 725 of the first conveyance screw 72, respectively. It is noted that, as shown in FIG. 3, the second second-connection piece 735 is located at a predetermined distance on an inside of the second second-shaft portion 737 in the axial direction of the second conveyance screw 73. The first, second, and third second-shaft portions 732A, 732B, and 732C are also provided to extend up to a region located at a predetermined distance on an inside of the second second-shaft portion 737 in the axial direction of the second conveyance screw 73. The second second-connection piece 735 connects them together.

The paddle 737P is a plate-like member which is disposed on an outside in the axial direction of the second second-connection piece 735. The axial direction thereof is the axial direction of the second conveyance screw 73. The paddle 737P is formed to extend from the rotational axis of the second conveyance screw 73 in the radial direction (front of the paper of FIG. 3). In this embodiment, the paddle 737P extends in the axial direction of the second conveyance screw 73 toward the second second-rib 732B. The second second-shaft portion 737 is provided at an outer portion in the axial direction of the paddle 737P. The second seal 737S described below is provided at an outer end edge in the axial direction of the paddle 737P. Its axial direction is the axial direction of the second conveyance screw 73. The paddle 737P transfers the developer from the second conveyance portion 74*b* to the first conveyance portion 74*a* via the second communication portion 704.

The second seal 737S is a circular ring-shaped elastic member which is provided on an exterior in the radial direction of the second second-shaft portion 737. When the second conveyance screw 73 is mounted in the development housing 70A, the second seal 737S comes into contact with the inner wall surface of the second wall portion 70B of the development housing 70A. As a result, the second seal 737S can prevent or reduce aggregation of the developer which would occur between the second second-shaft portion 737 and the inner wall surface of the second wall portion 70B as the second conveyance screw 73 is rotated.

Moreover, in the present embodiment, as shown in FIG. 3, the development device 70 includes a toner sensor 80 in a region of the first wall portion 70C which faces the first conveyance portion 74*a*. The toner sensor 80 is an eddy current type sensor. The toner sensor 80 outputs a current value. The current value corresponds to a pressure which the developer (toner) distributed inside the first wall portion 70C of the first conveyance portion 74*a* applies to the first wall portion 70C. As a result, the toner sensor 80 detects the amount of the developer stored in the developer reservoir section 74 of the development housing 70A.

<Advantages of First Rib Group 722>

Advantages of the first rib group 722 of the first conveyance screw 72 according to the present embodiment will be described next. It is noted that the second rib group 732 of the second conveyance screw 73 can exhibit the same advantages.

As described above, the first screw 721 of the first conveyance screw 72 is formed of hollow helical conveyance members. In other words, the first conveyance screw 72 has no shaft portion between the first first-shaft portion 726 and the second first-shaft portion 727. Accordingly, it can be prevented to increase the viscosity of the developer and to allow the developer to adhere to the shaft portions, which would occur when the developer in the developer reservoir section 74 degrades, or when the temperature around the development device 70 becomes high. Adhesion of the developer having increased viscosity to the shaft portions may decrease the conveyance performance of the conveyance screw including the shaft portions. However, as described above, the first conveyance screw 72 according to the present embodiment has a hollow shape, thereby solving such the problems.

By contrast, when the developer flowability decreases due to a high temperature environment and/or degradation of the developer, the developer is likely to be accumulated in the hollow interior of the first screw 721. As a result, the developer may aggregate into a cross-linked shape (bridge shape) in the hallow interior of the first screw 721. Such aggregation may be significant when the developer is a single-component developer. When the developer is a two-component developer, which contains toner and a carrier, the carrier may have a function of preventing or reducing aggregation of the toner.

Figure 6A:
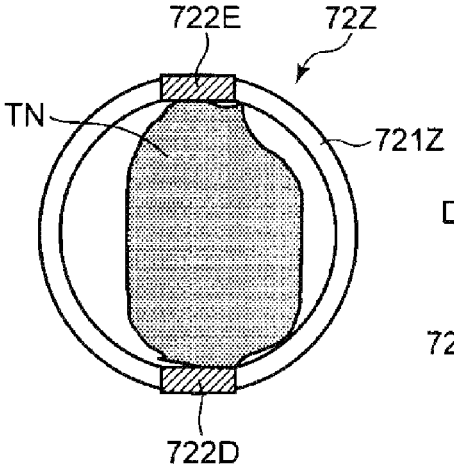
FIG. 6A is a cross sectional view showing a conveyance screw for comparison with the conveyance screw according to the embodiment of the present disclosure.
Figure 6B:
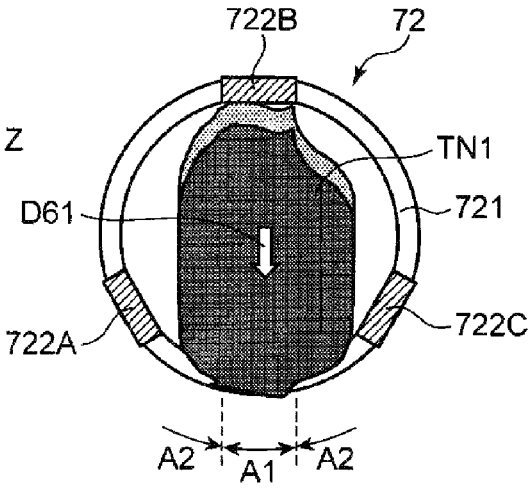
FIG. 6B is a cross sectional view showing the conveyance screw according to the embodiment of the present disclosure.

FIG. 6A is a cross sectional view of a conveyance screw 72Z for comparison with the first conveyance screw 72 according to the present embodiment. The conveyance screw 72Z includes a third screw 721Z as a hollow helical member, and a first third-rib 722E and a second third-rib 722D which bridge the helical pieces of the third screw 721Z. FIG. 6B is a cross sectional view of the first conveyance screw 72 according to the present embodiment.

Referring to FIG. 6B, in the first conveyance screw 72 according to the present embodiment, the first, second, and third first-ribs 722A, 722B, and 722C composing the first rib group 722 are disposed at regular intervals in the circumferential direction of the first conveyance screw 72, as described above. That is, the first, second, and third first-ribs 722A, 722B, and 722C are arranged at 120-degree intervals. Suppose herein that a region where the second first-rib 722B is projected on an opposite side of an outer circumferential surface of the first screw 721 through the rotational axis of the first conveyance screw 72 is referred to as a first region (a facing region) A1. Further, a region of the outer circumferential surface of the first screw 721 which is different from the first region A1 is referred to as a second region (non-facing region) A2. In this case, the first first-rib 722A and the third first-rib 722C are disposed in the second region A2.

By contrast, in the conveyance screw 72Z shown in FIG. 6A, the second third-rib 722D is provided in a region where the first third-rib 722E as one of rib members is projected on an opposite side of an outer circumferential surface of the third screw 721Z through the rotational axis of the conveyance screw 72Z. Accordingly, as the conveyance screw 72Z is rotated, the developer (toner) is likely to aggregate in a bridge shape (aggregate TN) between the first third-rib 722E and the second third-rib 722D. Such the aggregate TN may grow cylindrically in a hollow interior of the conveyance screw 72Z after all. Aggregation of the developer may decrease the conveyance performance of the conveyance screw 72Z.

On the other hand, in the first conveyance screw 72 shown in FIG. 6*b*, no other rib members are provided in the first region A1 located on the opposite side in the radial direction of the second first-rib 722B. Accordingly, as indicated by an arrow D61 in FIG. 6B, agglomerate TN1 of the toner, which may start growing in a bridge shape from the second first-rib 722B, can flow outside the first screw 721 from a gap between the helical pieces of the first screw 721 in the first region A1. In particular, when the second first-rib 722B is located perpendicularly above as the first screw 721 is rotated, the aggregate TN1 of the toner may move downward by its own weight to effectively flow outside the first screw 721. The same advantages can be obtained also in the second rib group 732 of the second conveyance screw 73. In the present embodiment, the aforementioned rib members are disposed at the regular intervals in the circumferential direction. As a result, the rib members can be prevented from being close to each other in the circumferential direction.

Further, in the present embodiment, as described above, the development device 70 includes the toner sensor 80 in a region of the first wall portion 70C which faces the first conveyance portion 74*a* (FIG. 3). When the developer aggregates in a bridge shape in an interior of the cylinder of the first conveyance screw 72, the developer may prevent from circulating in an interior of the developer reservoir section 74. In this case, the developer flowability may be unstable between the first first-connection piece 724 and the first wall portion 70C. This may result in inappropriate detection of the amount of the developer in an interior of the developer reservoir section 74 by the toner sensor 80. Even in this case, the first rib group 722 can prevent or reduce aggregation of the developer in the hollow interior of the first screw 721, as described above. As a result, the toner sensor 80 can accurately detect the amount of the developer in an interior of the developer reservoir section 74.

The development device 70 and the image forming apparatus 1 including the development device 70 according to the embodiment of the present invention have been descried above, which however, should not be taken to limit the present invention. The following variations may be possible, for example.

(1) In the present embodiment, the developer conveyance device has been described with reference to an interior of the development device 70, which however, should not be taken to limit the present disclosure. Any of tonner containers, toner cartridges, used toner conveyance devices, etc. may be employed as the developer conveyance device including the first conveyance screw 72 or the second conveyance screw 73. Even in these cases, aggregation in a bridge shape of the developer can be prevented or reduced in a hollow interior of the first screw 721 or the second screw 731.

(2) In the present embodiment, both the first conveyance screw 72 and the second conveyance screw 73 are formed in a hollow helical shape and include the first rib group 722 or the second rib group 732, which however, should not be taken to limit the present disclosure. One of the first conveyance screw 72 and the second conveyance screw 73 may be in a hollow helical shape and include a plurality of rib members. Further, the developer conveyance device may include a single conveyance screw (first conveyance screw 72 or second conveyance screw 73).

Figure 7:
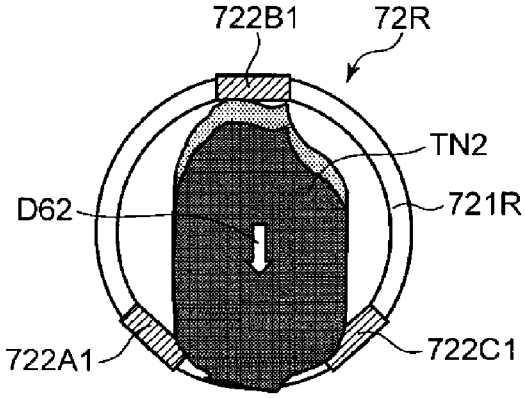
FIG. 7 is a cross sectional view showing a conveyance screw according to another embodiment of the present disclosure.

(3) Moreover, the present embodiment describes the case in which the first, second, and third first-ribs 722A, 722B, and 722C composing the first rib group 722 are disposed at regular 120-degree intervals in the circumferential direction of the first conveyance screw 72, which however, should not be taken to limit the present disclosure, as shown in FIG. 7. FIG. 7 is a cross sectional view of a first conveyance screw 72R according to another embodiment of the present disclosure. In the first conveyance screw 72R, a space between a first first-rib 722A1 and a third first-rib 722C1 is set smaller than the other spaces. However, as shown in FIG. 7, no other rib members are disposed in a region (first region or facing region) projected on an opposite side of each rib member through the rotational axis. Thus, aggregation in a bridge shape of the developer is effectively prevented or reduced in a hollow interior of the first conveyance screw 72R.

(4) Furthermore, the present embodiment describes the case in which the three rib members are disposed in the circumferential direction in the first conveyance screw 72 (second conveyance screw 73), which however, should not be taken to limit the present disclosure. Two rib members may be provided in the circumferential direction. Alternatively, four or more rib members may be provided.

According to the present disclosure, when viewed from one of the plurality of reinforcement members, the other reinforcement members are disposed in the non-facing region. Accordingly, the reinforcement members are disposed so as not to face each other through the rotational axis. Thus, aggregation in a bridge shape of the developer can be prevented or reduced between the reinforcement members in rotation of the conveyance screw.

It is preferable that three or more reinforcement members are provided in the circumferential direction. With this configuration, the three or more reinforcement members provided in the circumferential direction can stably bridge the helical pieces of the helical members.

The plurality of reinforcement members are preferably disposed at regular intervals in the circumferential direction. With this configuration, since the plurality of reinforcement members are disposed at the regular intervals in the circumferential direction, the reinforcement members can be prevented from being close to each other in the circumferential direction.

The conveyance member preferably includes a support member to connect each end portion in a direction of the rotational axis of the plurality of reinforcement members to the shaft portions. With this configuration, the support member can stably support the hollow helical member and the plurality of reinforcement members.

The conveyance member includes an elastic member provided on an outside in the radial direction of the shaft portions. With this configuration, aggregation of the developer which occurs between the shaft portions and the inner wall surfaces of the wall portions of the housing as the conveyance screw is rotated can be prevented or reduced.

Preferably, the development device according to the present disclosure includes a development roller which is rotatably supported by the housing to carry the developer, and the aforementioned developer conveyance device which conveys the developer to the development roller. With this configuration, the reinforcement members are disposed so as not to face each other through the rotational axis. Accordingly, aggregation in a bridge shape of the developer can be prevented or reduced between the reinforcement members in rotation of the conveyance screw. This can achieve stable conveyance of the developer in an interior of the development device. Further, adhesion of aggregate of the toner to the development roller can be prevented.

It is preferable that the developer is composed of single-component toner. With this configuration, aggregation in a bridge form of the toner used in the development device, which is single-component toner though, can be prevented or reduced in a hollow interior of the helical members. When the developer is a two-component developer of a carrier and toner, stiffing the developer may cause collision of the carrier on the toner. Accordingly, aggregation of the toner is hard to be caused when compared with the case of the single-component toner. By contrast, with the single-component toner, such a phenomenon is hard to be caused. The toner is likely to aggregate in a bridge shape in a hollow interior of the helical members. Even in this case, with the above configuration, provision of the plurality of reinforcement members in the circumferential direction can effectively prevent or reduce aggregation in a bridge shape of the single-component toner.

An image forming apparatus according to another aspect of the present disclosure includes an image carrier having a circumferential surface on which an electrostatic latent image is to be formed and disposed to face the development roller, and the aforementioned development device. With this configuration, the reinforcement members are disposed so as not to face each other through the rotational axis. Accordingly, aggregation in a bridge shape of the developer can be prevented or reduced between the reinforcement members in rotation of the conveyance screw. Thus, the developer can be stably conveyed in an interior of the development device. Further, adhesion of aggregate of the toner to the development roller can be prevented. Thus, a defect in image quality which occurs due to supply of aggregate of the toner to the image carrier can be effectively prevented or reduced.

What is claimed is:

1. A developer conveyance device comprising:

a housing; and a conveyance member supported by the housing and configured to rotate so as to convey developer, wherein the conveyance member includes:

a shaft portion configured to rotate about a rotational axis;

a hollow helical member which extends in a direction of the rotational axis and is formed in a helical shape; and a plurality of reinforcement members which support the helical member and extend in the direction of the rotational axis, the plurality of reinforcement members are disposed in a circumferential direction of rotation of the conveyance member, when viewing a cross section in a direction intersecting with the rotational axis, an outer circumferential surface of the helical member includes a facing region and a non-facing region, which are defined for one reinforcement member of the plurality of reinforcement members, the facing region being a region where the one reinforcement member of the plurality of reinforcement members is projected on an opposite side of an outer circumferential surface of the helical member through the rotational axis, and the non-facing region being a region of the outer circumferential surface of the helical member which is different from the facing region, the other reinforcement member of the plurality of reinforcement members is disposed in the non-facing region, and the plurality of reinforcement members support an inner peripheral part of the helical member.

2. The developer conveyance device of claim 1, wherein the plurality of reinforcement members include three or more reinforcement members disposed in the circumferential direction.

3. The developer conveyance device of claim 2, wherein the plurality of reinforcement members are disposed at regular intervals in the circumferential direction.

4. The developer conveyance device of claim 1, wherein the conveyance member includes a support member configured to connect end portions of the plurality of reinforcement members in the direction of the rotational axis to the shaft portion.

5. The developer conveyance device of claim 1, wherein the conveyance member includes an elastic member provided on an outside in a radial direction of the shaft portion.

6. A development device, comprising:

the developer conveyance device of claim 1; and a development roller rotatably supported by the housing and configured to carry the developer conveyed by the developer conveyance device.

7. The development device of claim 6, wherein the developer is composed of single-component toner.

8. An image forming apparatus, comprising:

the development device of claim 6; and an image carrier having a circumferential surface on which an electrostatic latent image is to be formed and provided so as to face the development roller.

* * * * *